US008604367B2

(12) United States Patent
DeCook et al.

(10) Patent No.: US 8,604,367 B2
(45) Date of Patent: Dec. 10, 2013

(54) CIRCUIT BREAKER WITH IMPROVED LOCK-OFF ACCESSORY

(75) Inventors: Steve DeCook, Marion, IA (US); John Winter, Cedar Rapids, IA (US); Alberto Montoya, Zacatecas (MX)

(73) Assignee: Schneider Electric USA, Inc., Palatine, IL (US)

( * ) Notice: Subject to any disclaimer, the term of this patent is extended or adjusted under 35 U.S.C. 154(b) by 1565 days.

(21) Appl. No.: 11/801,729

(22) Filed: May 10, 2007

(65) Prior Publication Data

US 2008/0277250 A1 Nov. 13, 2008

(51) Int. Cl.
*H01H 9/28* (2006.01)

(52) U.S. Cl.
USPC ..... 200/43.15

(58) Field of Classification Search
USPC ..... 200/43.01, 43.11–43.16, 43.19–43.23, 200/329–339
See application file for complete search history.

(56) References Cited

U.S. PATENT DOCUMENTS

| | | | | |
|---|---|---|---|---|
| 4,260,861 | A * | 4/1981 | DiMarco | 200/43.15 |
| 5,775,481 | A | 7/1998 | Lyke | |
| 5,817,998 | A | 10/1998 | Siebels et al. | |
| 6,396,008 | B1 | 5/2002 | Maloney et al. | |
| 6,940,027 | B1 | 9/2005 | Sipe | |
| 7,355,132 | B1 * | 4/2008 | Rezac et al. | 200/43.14 |

* cited by examiner

*Primary Examiner* — Amy Cohen Johnson
*Assistant Examiner* — Marina Fishman
(74) *Attorney, Agent, or Firm* — Locke Lord LLP

(57) ABSTRACT

A circuit breaker comprises a housing containing a trip mechanism, a handle coupled to the trip mechanism and movable between on and off positions, and a lock-off mechanism capable of holding the handle in its off position. The lock-off mechanism includes a bracket adapted to be mounted on the circuit breaker housing adjacent the movable handle, and a slide mounted on the bracket for movement parallel to the movement of the handle when the handle is moved from the off position to the on position. The slide projects into the path of movement of the handle for engaging the handle, and the bracket and the slide form openings that register with each other when the projecting portion of the slide is proximate the handle in the off position. The registered openings are sized and shaped to receive the shackle of a padlock for locking the slide to the bracket, and thus locking the handle in the off position.

2 Claims, 4 Drawing Sheets

CIRCUIT BREAKER WITH IMPROVED LOCK-OFF ACCESSORY

FIELD OF THE INVENTION

The present invention relates to a circuit breaker lock-off accessory that provides the function of locking "OFF" the handle of a circuit breaker so that it cannot be turned to the "ON" position.

BACKGROUND OF THE INVENTION

It is frequently necessary to ensure that electrical equipment cannot be operated, e.g., while maintenance work is being carried out. It is essential to ensure that circuit breakers associated with the equipment are secured in the "off" position, to protect against inadvertent operation of the breaker that could injure personnel or damage the equipment. A variety of methods have been used to secure the operating handles of circuit breakers in the "off" position, such as by locking a cabinet within which the circuit breakers are housed, or providing a locking tab mounted within a recess of a multi-pole circuit breaker housing. However, such locking tabs can be difficult to operate, and may be suitable only for multi-pole devices. It is also known to provide a locking attachment that may be screwed onto the circuit breaker housing. However, such locking attachments may require disconnection of the circuit breaker from the circuit before they can be mounted.

SUMMARY OF THE INVENTION

According to one embodiment of the present invention, a circuit breaker comprises a housing containing a trip mechanism, a handle coupled to the trip mechanism and movable between on and off positions, and a lock-off mechanism capable of holding the handle in its off position. The lock-off mechanism includes a bracket adapted to be mounted on the circuit breaker housing adjacent the movable handle, and a slide mounted on the bracket for movement parallel to the movement of the handle when the handle is moved from the off position to the on position. The slide projects into the path of movement of the handle for engaging the handle, and the bracket and the slide form openings that register with each other when the projecting portion of the slide is proximate the handle in the off position. The registered openings are sized and shaped to receive the shackle of a padlock for locking the slide to the bracket, and thus locking the handle in the off position.

In one specific embodiment, the top of the circuit breaker housing includes a raised portion having a pair of end walls, the housing also forms a slot at the base of each of the end walls, and the bracket includes a pair of mounting hooks extending into the slots to attach the bracket to the housing.

To ensure that the top surface of the raised portion of the circuit breaker housing is substantially unobstructed by the lock-off mechanism, the slide may be mounted flush with the inboard surface of the bracket.

The foregoing and additional aspects of the present invention will be apparent to those of ordinary skill in the art in view of the detailed description of various embodiments, which is made with reference to the drawings, a brief description of which is provided next.

BRIEF DESCRIPTION OF THE DRAWINGS

The foregoing and other advantages of the invention will become apparent upon reading the following detailed description and upon reference to the drawings.

Figure 1:
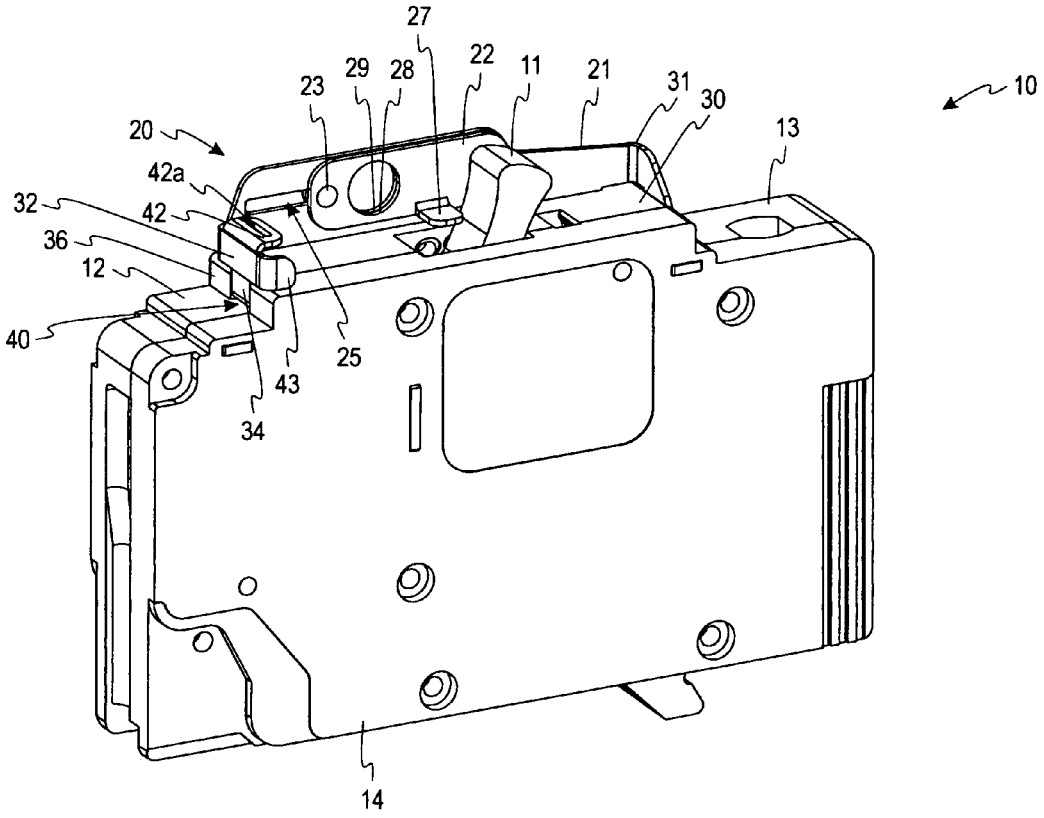
FIG. 1 is a left front perspective view of a circuit breaker equipped with on embodiment of an improved lock-off device, with the breaker handle in the "off" position and with the lock-off device in a position ready to receive a padlock.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE ILLUSTRATED EMBODIMENTS

Figure 2:
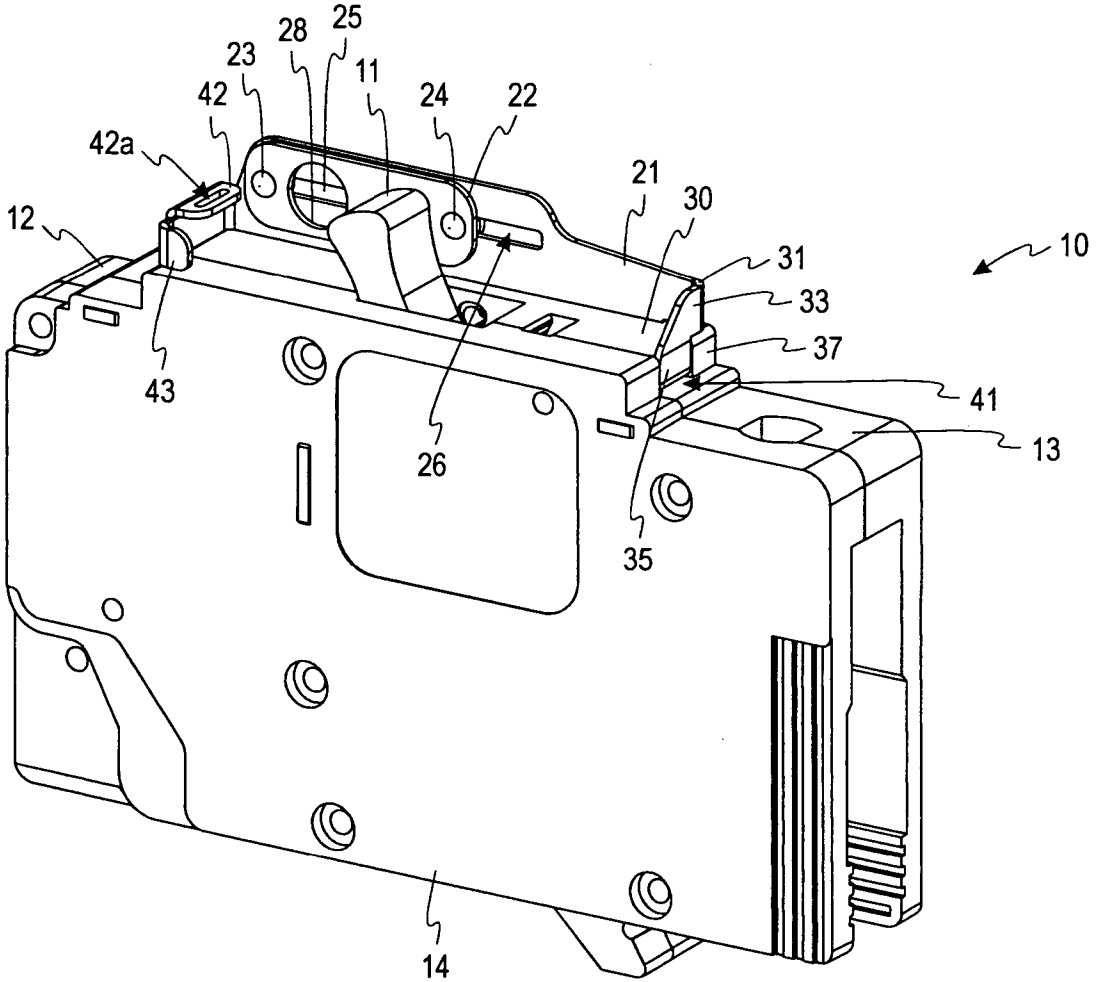
FIG. 2 is a right front perspective view of the circuit breaker shown in FIG. 1, with the breaker handle in the "on" position.
Figure 3:
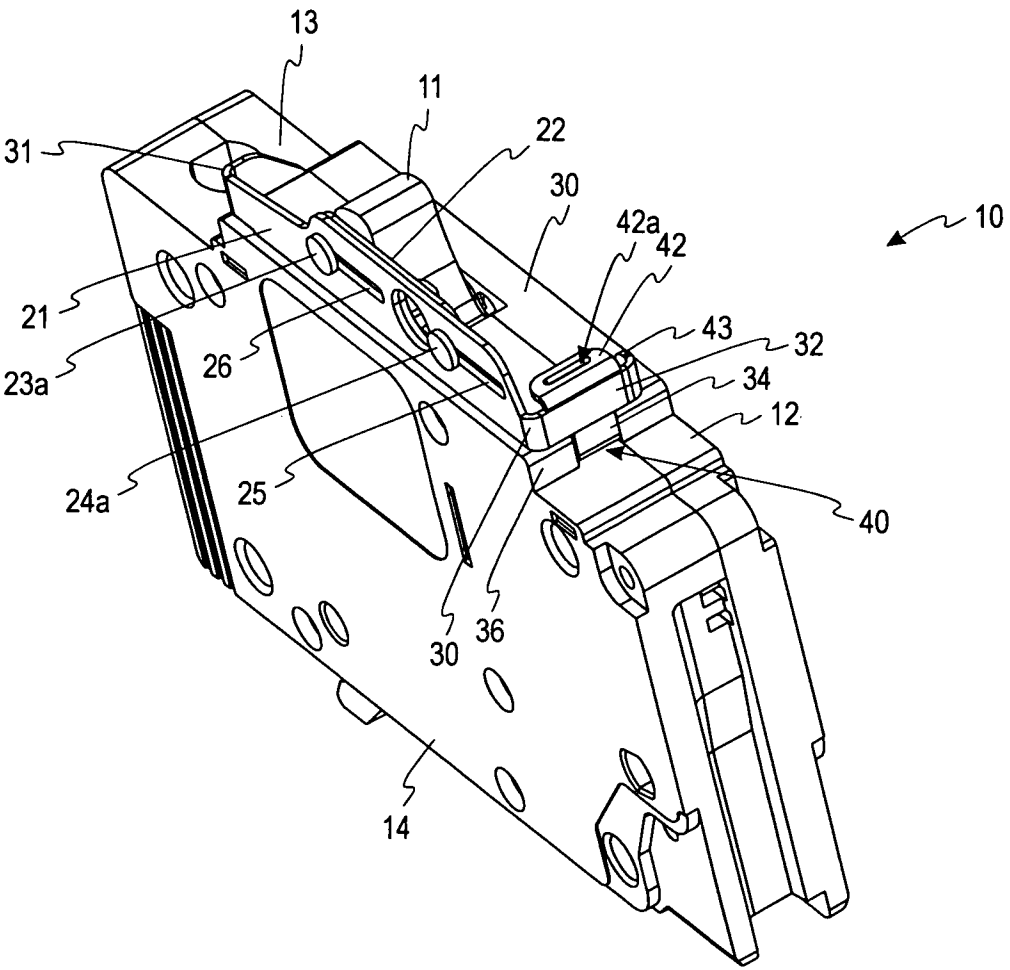
FIG. 3 is a rear perspective view of the circuit breaker shown in FIG. 1, from the same end shown in FIG. 2, with the breaker handle in the "off" position and with the lock-off device in a position ready to receive a padlock.

Turning now to the drawings and referring first to FIGS. 1-3, a circuit breaker 10 has a handle 11 movable between an "off" position, shown in FIGS. 1 and 3, and an "on" position, shown in FIG. 2. The power line controlled by the breaker is connected to "line" and "load" terminals accessible in opposite end portions 12 and 13 of the breaker housing 14. The power line is closed when the breaker is "on" and open when the breaker is "off." To prevent inadvertent or unauthorized movement of the breaker handle 11 from the "off" position to the "on" position, it is common to provide a lock-off device to lock the handle 11 in the "off" position.

Figure 4:
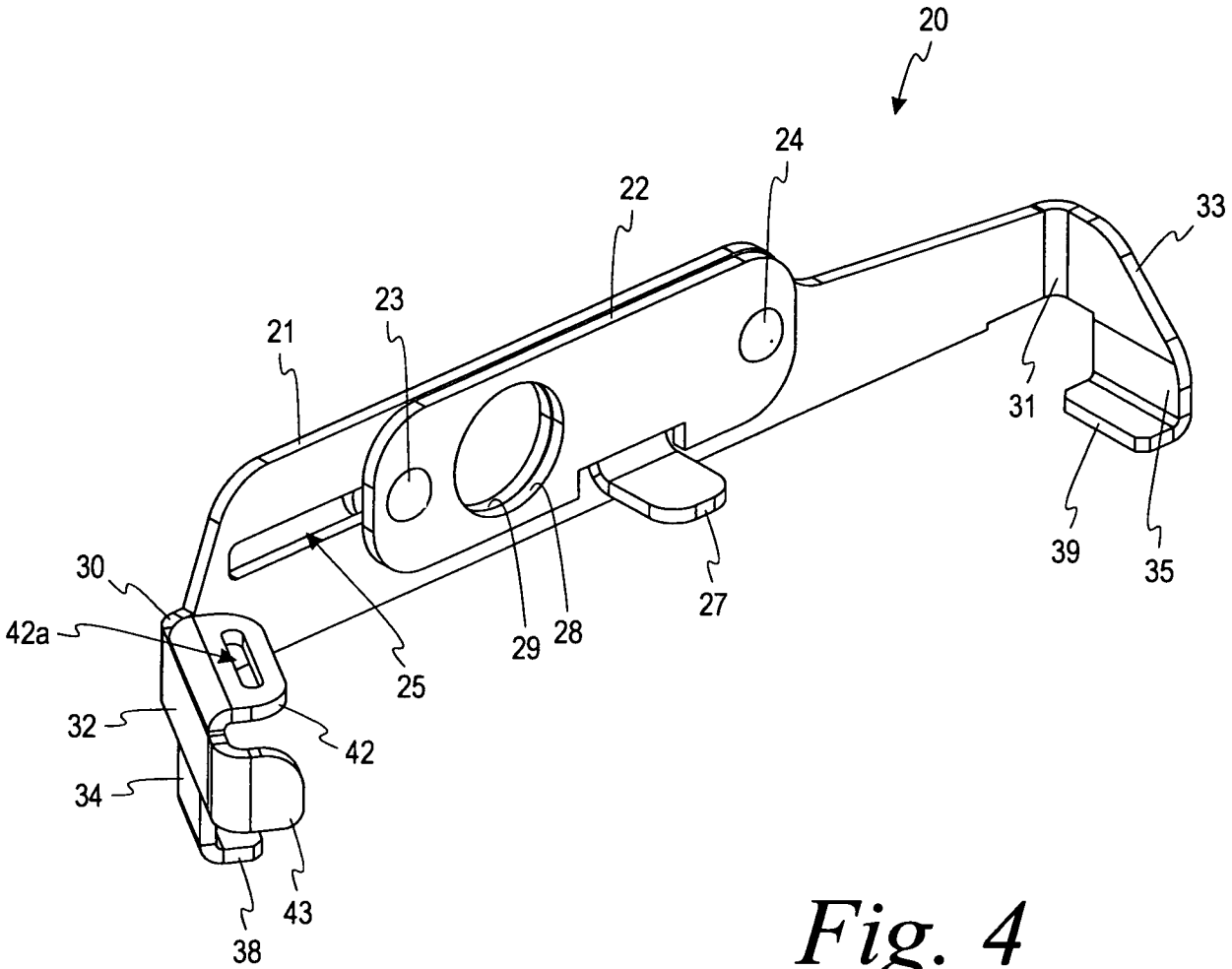
FIG. 4 is a perspective view of the lock-off device shown in FIGS. 1-3, prior to installation on the circuit breaker.

The breaker 10 shown in FIGS. 1-3 is equipped with a lock-off device 20, which is shown detached from the breaker in FIG. 4. This lock-off device 20 contains only four parts: a bracket 21, a slide 22 and a pair of shouldered rivets 23 and 24. The bracket 21 forms the main body portion of the lock-off device and is firmly attached to the circuit breaker 10, as described in detail below. The slide 22 is coupled to the bracket in a manner that allows the slide to reciprocate back and forth along the inner surface of the bracket 21, along a path parallel to the direction of movement of the breaker handle 11. This coupling of the slide 22 to the bracket 21 is achieved by the shouldered rivets 23 and 24, which are affixed to the slide 22 and extend laterally away from the slide through a pair of elongated slots 25 and 26, respectively, formed in the bracket 21. The slots 25 and 26 are slightly wider than the shanks of the rivets 23 and 24 so that the rivets can easily slid back and forth along the slots, while the rivets are held captive within the slots. The free ends of the rivets 23 and 24 form respective flanges 23*a* and 24*a*, on the outboard side of the bracket 21, to prevent detachment of the slide 22 from the bracket 21.

The lower edge of the slide 22 forms a tab 27 that extends laterally away from the main body portion of the slide into the path of movement of the breaker handle 11. It is this tab 27 that locks the handle 11 in the "off" position, when the slide 22 and bracket 21 are locked together to prevent movement of the slide 22 relative to the bracket 21. The slide 22 and the bracket 21 form a pair of apertures 28 and 29 that register with each other to form a through-hole when the slide 22 is in its most advanced position toward the "off" position of the handle 11. The shackle of a conventional padlock can then be inserted through the hole formed by the registered apertures

28 and 29 to block any relative movement between the slide 22 and the bracket 21, thereby holding the tab 27 firmly in position to block any movement of the handle 11 away from its "off" position. Thus, the handle 11 is locked in its "off" position as long as the padlock remains attached to the bracket 21 and slide 22, thereby ensuring that only authorized personnel who control the padlock can unlock the lock-off device to permit the breaker handle 11 to be moved to its "on" position.

When the padlock is removed from the lock-off device, the handle 11 can be moved to its "on" position, pushing the free-sliding slide 22 while the slots 25 and 26 control the direction and distance of travel of the slide 22. FIG. 2 depicts the handle 11 in its "on" position. The slide 22 has been moved to the left as viewed in FIG. 2, and the hole 28 is now positioned over the slot 25. Both of the slots 25 and 26 are too narrow (e.g., slightly less than ⅛ inch) to pass a padlock shackle, which typically has a diameter within the range of ⅛ to ⅜ inch. Thus, a padlock shackle cannot be inadvertently inserted through the slide hole 28 when it is aligned with the slot 25, rather than the larger hole 29 intended to receive the padlock shackle. The padlock can be applied only when the two holes 28 and 29 are in register with each other, which requires that the handle 11 be located in its "off" position, thus providing a lock-off only device that cannot be used to lock the handle in its "on" position.

The lock-off device 20 is designed to fit over a raised portion 30 of the housing 14. The raised portion 30 surrounds the handle 11 on the top of the circuit breaker housing 14, and extends between the two end portions 12 and 13 of the housing. Printed indicia are typically provided on the top surface of the area 14, where such indicia will be readily viewable by the user. The bracket 21 of the lock-off device 20 rests on the top surface of the raised area 30.

As clearly shown in FIG. 4, the entire bracket 21 is a single, unitary element having a general U shape formed by bends 31 and 31*a* at opposite ends of the main central portion of the bracket. The bends 31 and 31*a* form two short legs 32 and 33 that extend along the ends of the raised area 30. Extending from the lower edges of the legs 32 and 33 are respective mounting hooks 34 and 35 that extend downwardly over the vertical end walls 36 and 37 of the raised portion 30. The lower ends of the mounting hooks 34 and 35 are bent at right angles to form a pair of horizontal tabs 38 and 39 that fit into a pair of complementary slots 40 and 41 formed in the housing 14 at the bases of the end walls 36 and 37, respectively. The mounting hooks thus positively engage the housing 14 to hold the bracket 21 securely in place on the housing 14.

Before the bracket 21 is mounted on the circuit breaker, the bend 30 forms an angle greater than 90 degrees, e.g., 145 degrees, with respect to the inner surface of the slotted portion of the bracket 21. This permits the installer to first insert the tab 39 into the slot 41, and then bend the leg 32 inwardly until the upper portion of the mounting hook 34 engages the end wall 36. This bending of the leg 32, which reduces the 145-degree angle of the bend 31 to about 90 degrees, advances the tab 38 into the slot 40, thereby attaching the bracket 21 securely to the housing 14. To facilitate the manual bending of the leg 32, a slotted tab 42 is formed on the upper edge of the leg 32 to permit a screwdriver to be inserted into the slot 42*a* to provide the leverage needed to effect the bending. The installation should be performed with the handle 11 in the "off" position. A stabilizing tab 43 is formed on the end of the leg 32 to extend inwardly over a short length of the raised portion 30 to provide alignment and stability for the installed bracket.

It can be seen that the lock-off accessory provides a narrow edge profile to the top surface of the circuit breaker so that printed information that is provided on that top surface can be readily seen by customers and users. Because the moving slide of the lock-off accessory is free-moving within the slots of the bracket, there is no need to move or position the slide when the handle of the breaker is engaged to turn the breaker "on" or "off." Thus, the lock-off device is easy for the customer to use since the slide does not restrict the handle motion. Because the slide's full operating range is within a small working area, the installed lock-off device remains within the "trim-out" area of the circuit breaker and panelboard interface. The slide design also avoids pinching the user's fingers between the breaker handle and the locking tab when the lock-off is engaged.

The design of the lock-off device also provides a stable platform on the top surface of the circuit breaker. Engagement of the mounting hooks with the breaker housing, in conjunction with the various right-angle bends, provide a high degree of stability. The lock-off bracket can withstand high pulling forces in all directions due to the above-mentioned geometry.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

The invention claimed is:

1. A lock-off mechanism for a circuit breaker having a housing containing a handle movable between on and off positions, said mechanism comprising a bracket adapted to be mounted on the circuit breaker housing adjacent the movable handle, and a slide mounted on said bracket for movement parallel to the movement of said handle when said handle is moved from the off position to the on position, said slide having a tab projecting into the path of movement of said handle for engaging said handle, said bracket and said slide forming openings that mate with each other when said tab is proximate said handle in the off position, said mating openings being sized and shaped to receive the shackle of a padlock for locking said slide to said bracket so that said tab locks said handle in the off position, the top of said housing including a raised portion having a pair of outside end walls, and said housing forming a slot at the base of each of said outside end walls, and wherein said bracket is adapted to be mounted on the top surface of said raised portion and includes a pair of mounting hooks adapted to fit into said slots for attaching said bracket to said housing, and said bracket is generally U-shaped in a top plan view, with the legs of the U forming said mounting hooks.

2. The lock-off mechanism of claim 1 in which one of said legs of said U form a stabilizing tab for engaging the top surface of said raised portion.

* * * * *